US006023952A

United States Patent [19]

Mantarakis et al.

[11] Patent Number: 6,023,952

[45] Date of Patent: Feb. 15, 2000

[54] DOOR HANDLE WITH OFFSET LOCK ACTUATOR

[75] Inventors: Petros Z. Mantarakis, Northridge; Kevin Michael Argo, Tujunga, both of Calif.

[73] Assignee: Reflectolite Products, Inc., Pacoima, Calif.

[21] Appl. No.: 08/957,863

[22] Filed: Oct. 27, 1997

[51] Int. Cl.[7] ..... E05B 65/08

[52] U.S. Cl. ..... 70/99; 292/142; 292/172; 292/336.3

[58] Field of Search ..... 70/99, 107, 108, 70/190; 292/22, 39, 51, 112, 142, 172, 199, 336.3, 347

[56] References Cited

U.S. PATENT DOCUMENTS

| | | | |
|---|---|---|---|
| 2,862,750 | 12/1958 | Minke | 292/172 |
| 3,082,029 | 3/1963 | Riegelman | 292/49 |
| 3,744,829 | 7/1973 | Germer | 292/22 |
| 4,384,465 | 5/1983 | Muus | 292/172 X |
| 4,606,203 | 8/1986 | Esser | 292/39 X |
| 4,663,951 | 5/1987 | Poulin | 70/168 |
| 4,754,624 | 7/1988 | Fleming et al. | 70/99 X |
| 4,934,800 | 6/1990 | Choi | 292/172 |
| 5,102,174 | 4/1992 | Prevot | 292/142 X |
| 5,172,944 | 12/1992 | Munich et al. | 292/39 |
| 5,214,946 | 6/1993 | Antonello | 70/279 |
| 5,265,924 | 11/1993 | Kim | 292/347 X |
| 5,437,485 | 8/1995 | Goldschmidt | 292/142 |
| 5,482,334 | 1/1996 | Hotzl | 292/142 X |
| 5,495,731 | 3/1996 | Riznik | 292/39 X |
| 5,496,082 | 3/1996 | Zuckerman | 292/172 X |
| 5,561,994 | 10/1996 | Smith et al. | 70/99 |
| 5,707,090 | 1/1998 | Sedley | 292/172 |
| 5,722,269 | 3/1998 | Simon et al. | 292/39 X |
| 5,810,402 | 9/1998 | Armstrong | 292/172 X |

*Primary Examiner*—Suzanne Dino Barrett
*Attorney, Agent, or Firm*—Renner, Otto, Boiselle & Sklar, P.L.L.

[57] ABSTRACT

A door handle assembly comprises an interior handle connected to the interior face of a door, a latch mechanism which is operable between latched and unlatched positions to secure the door, an operator mounted to the door and rotatable with respect to the handle, and a rack and pinion assembly to transfer the rotary motion of the operator to the latch mechanism. The operator includes a tumbler assembly. The rack and pinion assembly may include a rack and two pinions one located at each end of the rack. However, other arrangements are possible including gear trains comprising two or three gears driven by the rack. The rack and pinion assembly may be mounted between a pair of planar members which form part of a housing which is proportioned to fit between the latch mechanism and an interior surface of a stile of a door. The rack and pinion assembly permits the latch mechanism and the operator, which have usually been coaxial, to be vertically offset from each other.

37 Claims, 5 Drawing Sheets

DOOR HANDLE WITH OFFSET LOCK ACTUATOR

FIELD OF THE INVENTION

The present invention relates to door handles, and in particular to door handles with locks built in for installation in doors made with hollow stiles.

BACKGROUND OF THE INVENTION

Many doors of contemporary manufacture are formed from hollow channel sections. The channel sections may be extruded aluminum or vinyl, or formed of steel. Such doors have been provided with a latch mechanism to lock the door. Typically the latch mechanism is mounted inside the hollow channel with a hook or latch element which extends through an opening in the edge face of the channel. The latch mechanism has been mounted to the stile by a pair of machine screws which extend through the channel and thread into a flange which is part of the latch mechanism.

Prior art latch mechanisms have been actuated on the interior side of the door by a rotatable lever mounted to an escutcheon or similar plate on the interior face of the door. The lever rotates a tang, and the tang, in turn, extends through an opening in the interior face of the hollow stile and then into a hub which is part of the latch mechanism. Rotation of the lever causes the tang to shift the latch element between extended and retracted positions.

In the prior art, when a key lock has been added to such a door, the tumbler mechanism has been mounted so that a tang projecting from the back of the tumbler assembly is coaxial with the tang extending from the manually operated lever. For many handle designs, especially those where the handle mounts to the escutcheon at a pair of mounting points and where the interior actuating lever is to be midway between the two handle mounting points, this has required the tumbler assembly to be mounted in a housing which projects outward from the stile on its exterior surface. In this location the tumbler assembly is open to attack by those seeking unauthorized entry, and it is in a position which may be awkward for the operator because it may be surrounded by a door handle.

SUMMARY OF THE INVENTION

The present invention provides a unique arrangement of latch mechanisms, levers for interior actuation of the latch mechanisms, and tumbler assemblies for exterior actuation of the latch mechanism for use in doors, particularly doors with hollow stiles. In one embodiment, the interior lever is located, as in the prior art, centrally of the interior handle, while the tumbler assembly is mounted above the lever in a post which supports and forms a part of the exterior handle. A rack and pinion arrangement my be located either inside the stile or within the escutcheon to which the exterior handle is mounted. This arrangement not only makes the tumbler more easily accessible but also makes it more secure than had been the prior practice. In another embodiment, the tumbler and interior lever have coaxial tangs, but they are displaced from the hub of the latch mechanism, and so the tumbler assembly may be recessed into the door, thus making it readily accessible and secure. In yet another arrangement, the door is provided with two latch assemblies which are vertically offset from each other and actuated by a shared interior lever.

In each of these embodiments a rack and pinion assembly that is made to fit inside a hollow stile of the door beside a conventional latch assembly is connected to the hub of the latch mechanism. The rack and pinion assembly includes an input hub which turns a first pinion and an output hub turned by a second pinion, the two pinions being operatively connected by a rack. The rack and pinion assembly may be provided with a gear train connecting plural input hubs with the rack and with a gear train connecting plural output hubs with the rack. The plural input and output hubs enable the rack and pinion assembly to accommodate a variety of different conventional latch assemblies and handle styles.

These and other features of the present invention will be clear to those of skill in the art upon reading the following specification and the appended claims.

DESCRIPTION OF THE PREFERRED EMBODIMENT

Figure 1:
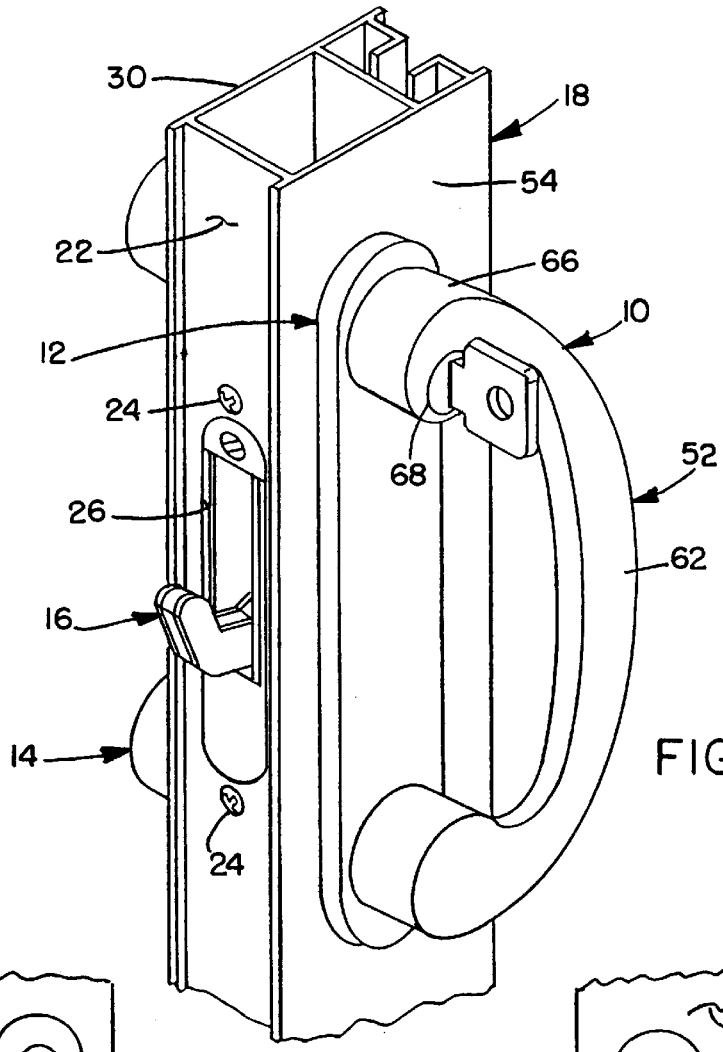
FIG. 1 is a perspective illustration of a door handle assembly comprising interior and exterior handles and a latch mechanism constructed in accordance with the present invention and mounted to a door frame member.

The door handle assembly 10 (FIG. 1) includes an exterior handle assembly 12, an interior handle assembly 14, and a latch assembly 16. The door handle assembly 10 is mounted to the stile 18 of a door such as a sliding patio door. The stile 18 is hollow and may be made of extruded aluminum or vinyl. Alternatively, the stile 18 may be of formed steel or wood, provided the appropriate spaces are formed in the stile to receive the door handle assembly 10. Moreover, while FIG. 1 illustrates a section of a sliding patio door, the present invention is equally suitable for use with hinged doors.

The latch assembly 16 is a conventional assembly. It is mounted to the edge 22 of the stile 18 by a pair of machine screws 24. Latch assembly 16 may be installed either by inserting it through an oval opening 26 in the edge 22 of the stile 18, or by sliding it down the length of the interior of the stile 18. In either event, once the latch assembly 16 is properly positioned in the oval opening 26, machine screws 24 may be installed to hold the latch assembly in place.

Figure 4:
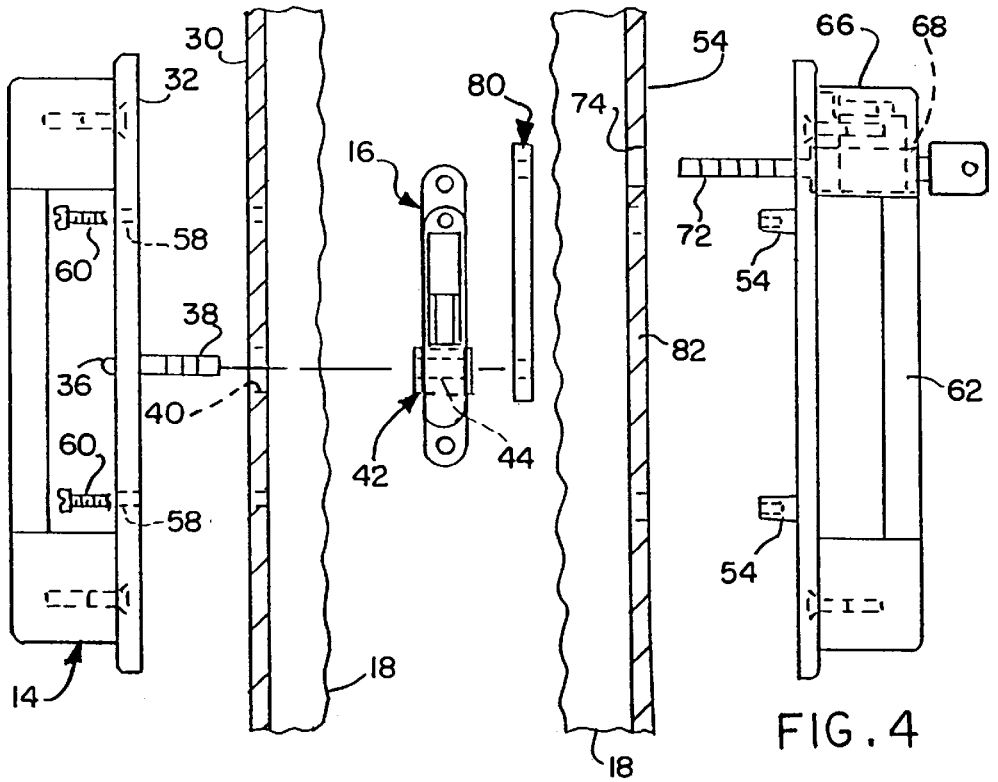
FIG. 4 is a front elevation view, partly in section, and exploded, showing the interior and exterior handles, the latch mechanism, and a rack and pinion assembly constructed in accordance with the present invention.

The interior handle assembly 14 (FIG. 2) is mounted on the interior face 30 of the stile 18. The interior handle assembly 14 includes an escutcheon 32 and an interior grip assembly 34 which is mounted to the escutcheon 32. An actuating lever 36 is mounted behind the escutcheon 32. The actuating lever 36 includes a tang 38 (FIGS. 2 and 4) which extends through an opening 40 in the interior face 30 of the stile 18 to engage the latch assembly 16. The tang 38 is a conventional flat tang. As is conventional, the tang 38 may be manufactured with creases to facilitate snapping it off at the desired length to accommodate different thicknesses of stiles. Tang 38 is rectangular in cross section and it is received in a conventional actuating hub 42 (FIG. 4). The actuating hub 42 has a rectangular slot 44 all the way through it. When the interior handle assembly 14 is mounted to the stile 18, the tang 38 is guided into the slot 44 through the hub 42. Then, upon rotation of the actuating lever 36, the tang 38 rotates the hub 42 to move the latch assembly 16 between its extended position (shown in FIG. 1) and a retracted position (not shown).

The exterior handle assembly 12 includes an exterior escutcheon 50 and an exterior grip assembly 52 which is mounted to the exterior escutcheon. The exterior escutcheon 50 (FIG. 4) includes a pair of posts 54 which project interiorly from the escutcheon. When the exterior handle assembly 12 is mounted to the exterior face 56 of the stile 18, the posts 54 pass through openings formed in the stile 18. The posts 54 align with openings 58 in the interior escutcheon 32 so that machine screws 60 can pass through the openings in the stile 18, and be threaded into the posts 54 to hold the two handle assemblies to the stile 18.

The exterior grip assembly 52 includes a roughly C-shaped grip 62 which is mounted on a pair of posts 64 and 66 which space the grip 62 away from the exterior face 54 of the stile 18. The post 66 houses a tumbler assembly 68. The tumbler assembly 68 is conventional, and it is received in an internal socket formed in the post 66. The tumbler assembly 68 includes a tumbler tang 72 which extends from the post 66 toward the interior of the stile 18. When the exterior handle assembly 12 is mounted on the stile 18, the tumbler tang 72 extends through an opening 74 in the exterior face 54 of the stile 18 and into the interior of the stile. The tumbler tang 72 is then generally parallel to but spaced vertically from the barrel 42 of the latch assembly.

The door handle assembly 10 of the present invention includes a rack and pinion assembly 80 which transmits the rotary motion of the tumbler tang 72 to a location adjacent the actuating barrel 42 of the latch assembly 16. The rack and pinion assembly 80 is slender and can fit inside the stile 18 between the latch assembly 16 and the wall 82 of the stile. In one commercial embodiment, the rack and pinion assembly 80 is less than one-quarter inch thick.

Figure 5:
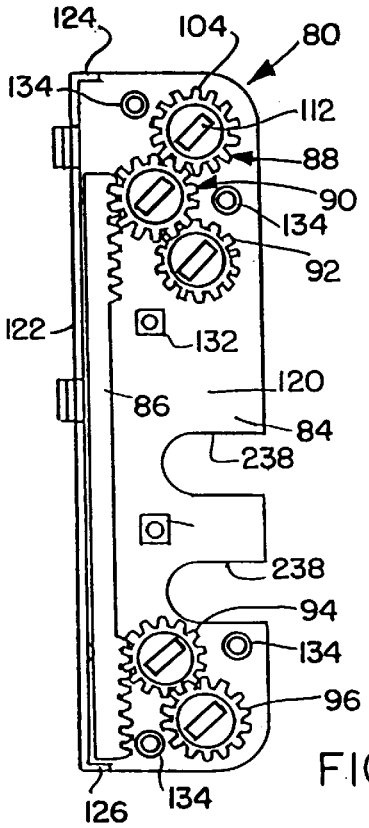
FIG. 5 is a front elevation view of the rack and pinion assembly of FIG. 4 with a cover of the assembly removed.
Figure 6:
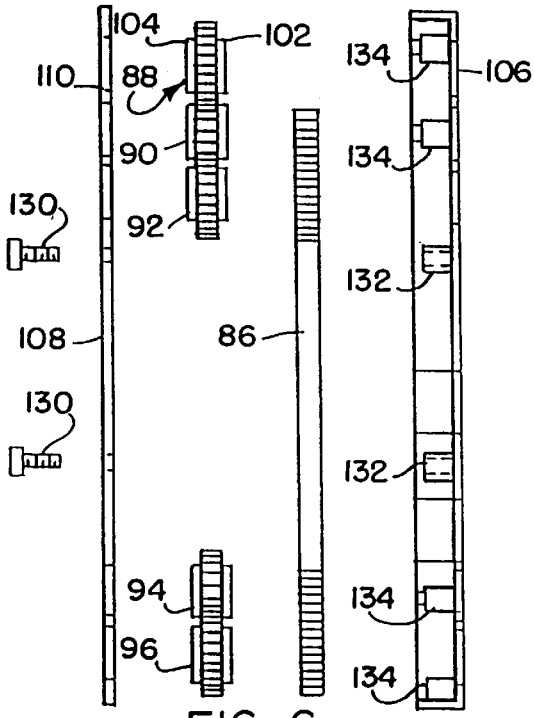
FIG. 6 is an exploded elevation view of the rack and pinion assembly of FIG. 4.

The rack and pinion assembly 80 is shown with its front cover removed in FIG. 5. The assembly includes a bottom plate 84, a rack 86, and five spur gears 88–96. The spur gears 88–96 are identical, and only the spur gear 88 will be described in detail, it being understood that the description applies equally to the remaining spur gears. The spur gear 88 includes peripheral teeth 100, and on opposite sides cylindrical bearing surfaces 102 and 104 (FIG. 6). The bottom plate 84 includes a cylindrical opening 106 proportioned to rotatably receive the bearing surface 102, and the top plate 108 includes an aligned opening 110. When the top plate 108 is mounted to the bottom plate 84, the gear 88 is trapped between them and rotatable about the common axes of openings 106 and 110.

The gear 88 includes a centrally located rectangular slot 112 which extends all the way through the gear 88. The slot 112 is proportioned to receive the tang 72 of the tumbler assembly 68 so that rotation of the tang 72 causes the gear 88 to rotate. The bottom plate 84 includes a generally rectangular flat portion 120 (FIGS. 5 and 6) which has a rear wall 122 that extends at right angles to the flat portion 120 along the left edge thereof as viewed in FIG. 5. The rear wall 122 is positioned with respect to the gears 90 and 94 so that the rack 86 is held in meshing engagement with the gears 90 and 94. The rear wall 122 extends for a short distance across the bottom and top edges 124 and 126. These extensions 124 and 126 of the rear wall provide stops which limit the extent of travel of the rack 86 at the top and bottom of its stroke, respectively.

As noted above, the gear 88 is mounted for rotation in openings 106 and 110 in the bottom plate 84 and top plate 108, respectively. Similar openings in the bottom plate 84 and top plate 108 support the gears 90, 92, 94, and 96. As illustrated in FIG. 5, the gears 88 and 92 are positioned to mesh with gear 90. Gear 90 in turn meshes with the rack 86 at the upper end portion (as viewed in FIG. 5) of the rack and pinion assembly 80. At the lower end portion of the rack and pinion assembly, the gear 94 is mounted to mesh both with the rack 86 and with the gear 96.

The top plate 108 (FIG. 6) is held in place by a pair of machine screws 130 which thread into bosses 132. In addition, four bosses project outward from the bottom plate 84 to support the top plate 108. Each of the bosses 134 has a shoulder at its upper end which abuts the interior surface of the top plate 108.

When the exterior handle assembly 12 and interior handle assembly 14 are mounted to the stile 18 with the latch assembly 16 in place, the tang 38 which is connected to the actuating lever 36 extends through the slot 44 in the hub 42 of the latch assembly and into the slot formed in gear 96. Accordingly, when the key is inserted into the tumbler assembly 68 and the key is turned, the tang 72 turns gear 88. This motion is transmitted through gear 90 to the rack 86 which in turn causes rotation of the gears 94 and 96. Gear 96, as noted, is connected by means of the tang 38 to the hub 42 of the latch assembly 16. Thus rotary motion from the tumbler assembly is transmitted to operate the latch assembly 16.

Because all of the gears 88–96 are identical, there are a number of different locations at which a tang such as tang 72 can be inserted into the rack and pinion assembly 80. This permits the rack and pinion assembly 80 to be used with latch assemblies of different configuration and exterior handle assemblies of different proportions.

Figure 9:
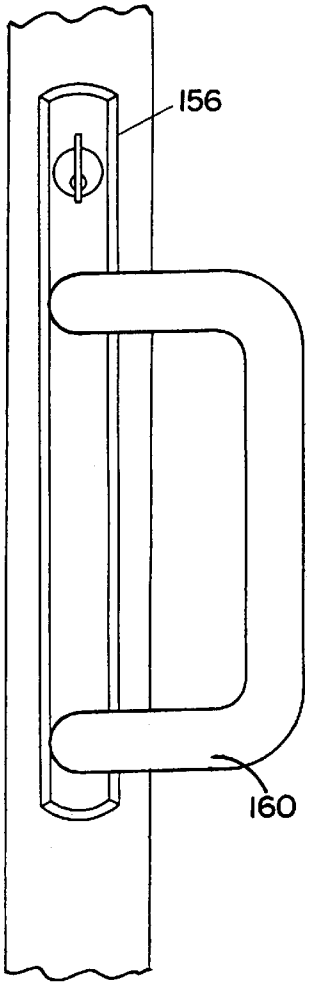
FIG. 9 is an elevation view of the exterior handle of the assembly of FIG. 7.
Figure 7:
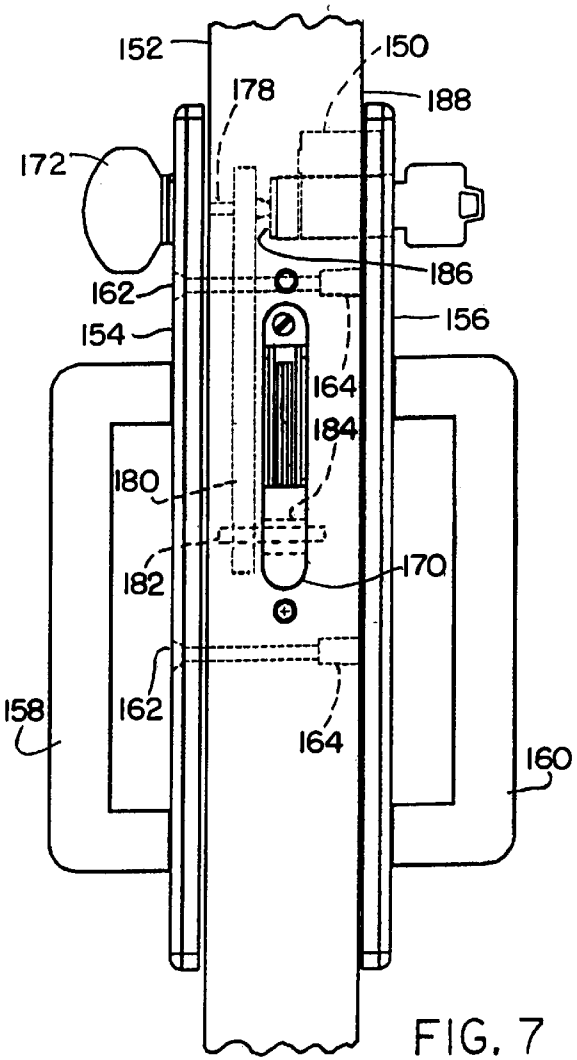
FIG. 7 is a front elevation view of a second embodiment of the present invention comprising interior and exterior handles, a latch mechanism and a rack and pinion assembly.
Figure 8:
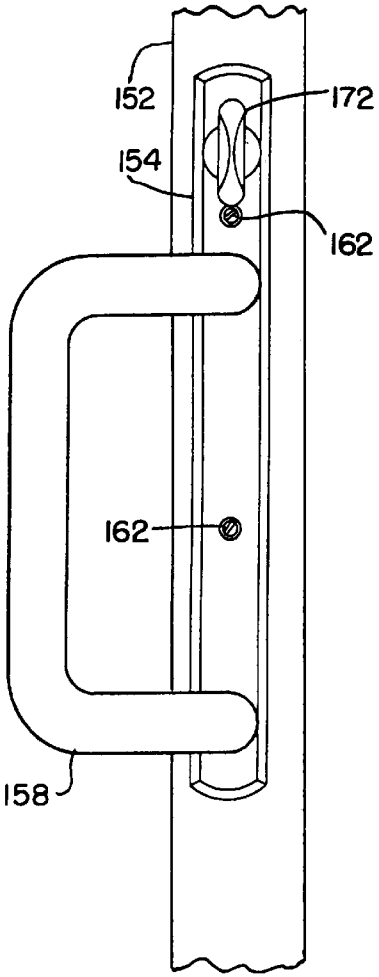
FIG. 8 is an elevation view of the interior door handle of the assembly of FIG. 7.

FIGS. 7 through 9 illustrate a second embodiment of the present invention. In this embodiment, the tumbler assembly 150 is mounted inside the door stile 152. The interior and exterior escutcheons 154 and 156, respectively, support interior and exterior grips 158 and 160, respectively. The escutcheons extend along the face of the stile above the top of the grips. The escutcheons are secured to each other and to the stile by means of machine screws 162 which extend though the interior escutcheon, through holes in the stile and into bosses 164 which project inward from the exterior escutcheon. As in the previously described embodiment, a latch mechanism 170 is mounted to the stile 152 at a location that is between the machine screws 162 which hole the escutcheons 154 and 156 in place. This allows conventional door manufacturing tools to be used to machine the necessary openings in the stile 152 without significant adjustment.

An interior actuator 172 is mounted to the escutcheon 154 above the top of the grip 158. As shown, the actuator 172 is a thumb turn handle which is rotated by gripping it on opposite sides and turning it. The lever type actuator illustrated in FIG. 24 is functionally interchangeable and may also be used. The tumbler assembly 150 includes a tang 178 which extends into a rectangular socket (not shown) in the interior actuator 172 so that the two are linked and rotate together.

The tang 178 is vertically spaced above the latch mechanism 70. A rack and pinion assembly 180 is used to connect the tang 178 to the actuator hub 182 of the latch mechanism 170. The rack and pinion assembly 180 is identical to the rack and pinion assembly 80 described in connection with the embodiment shown in FIGS. 1–4, and so requires no further description. When the interior actuator 172 or the tumbler assembly 150 turns the tang 178, the rotary motion is transmitted through the rack and pinion assembly and through a stub shaft 182 to the actuator hub 184 of the latch mechanism 170.

In the embodiment illustrated in FIGS. 7–9, the tumbler assembly 150 is mounted substantially inside the stile 152, rather than being in a housing projecting outward from the escutcheon or the exterior face of the stile 152. The extent to which the tumbler assembly projects into the stile depends, of course, on the thickness of the escutcheon or other mounting equipment as well as the length of the tumbler assembly. In most tumbler mountings the outermost face of the tumbler assembly will project at least slightly outward from the face of the stile.

Mounting the tumbler assembly substantially within the stile provides a secure mounting for the tumbler assembly since it cannot readily be knocked off the escutcheon by force. As a practical matter, this advantage begins to arise as soon as the end face 186 is inside the outer face 188 of the stile 152, and increases the more deeply the tumbler assembly is set into the stile. For purposes of this specification, the tumbler assembly is considered to be substantially within the stile when the end face 186 is inside the face 188 of the stile. Such a mounting has not been possible in the past because the stile has not been thick enough to make room for the latch mechanism and the tumbler assembly. By having the tumbler assembly mounted above the latch mechanism, the former is able to be positioned within the stile 152.

Figure 2:
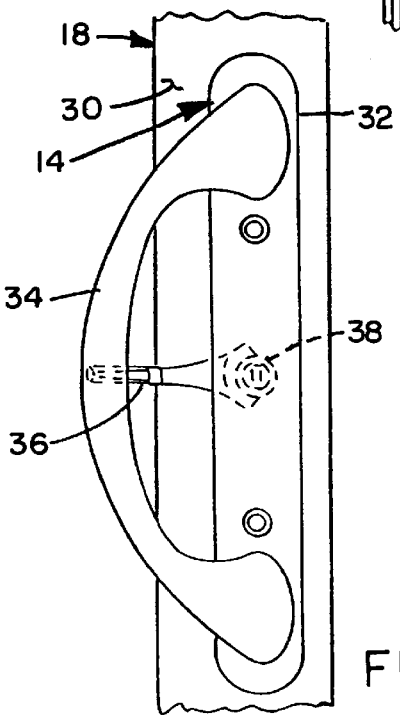
FIG. 2 is an elevation view of the interior door handle of the assembly of FIG. 1.
Figure 3:
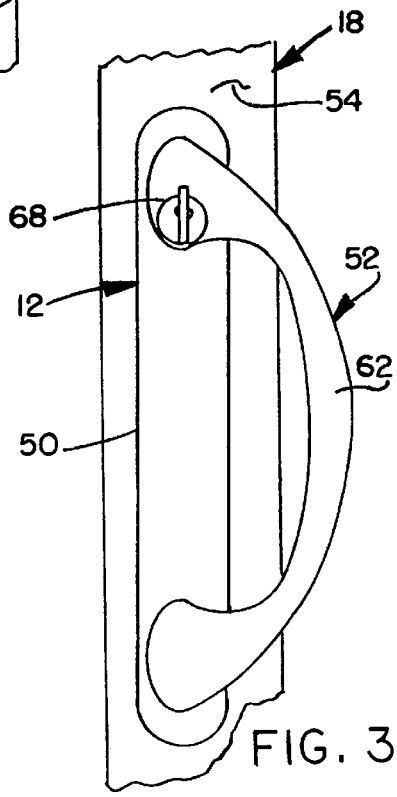
FIG. 3 is an elevation view of the exterior door handle of the assembly of FIG. 1.
Figure 10:
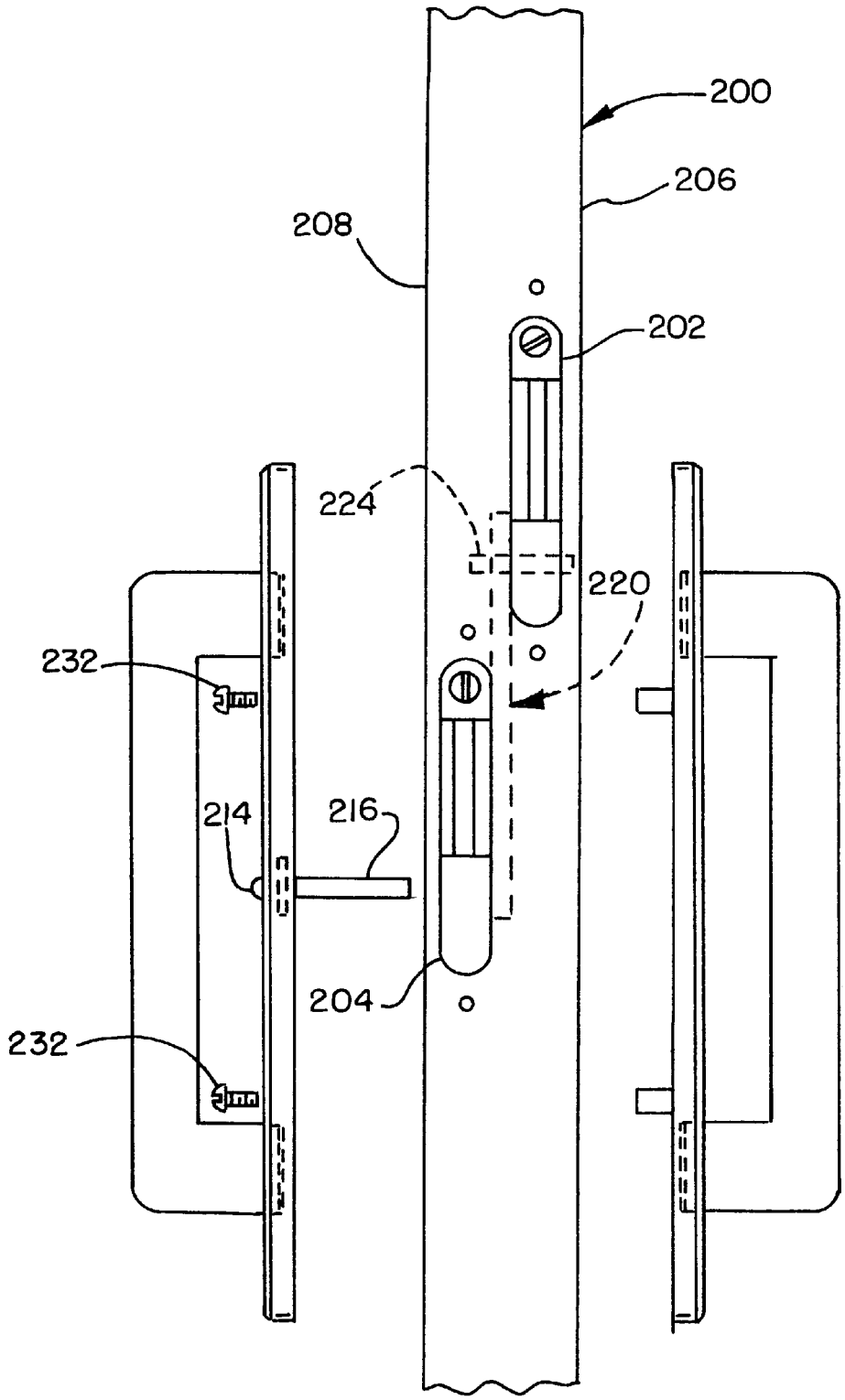
FIG. 10 is an exploded front elevation view of another embodiment of the present invention utilizing two latch mechanisms and a rack and pinion assembly to interconnect them.

FIG. 10 illustrates yet another embodiment of the present invention. In FIG. 10, a door 200 is fitted with two latch mechanisms 202 and 204. The latch mechanisms are conventional and identical to the latch mechanism 16 illustrated and described in connection with FIGS. 1–4. The latch mechanisms 202 and 204 are mounted one above the other, in a staggered fashion so that the upper latch 202 is closer to the exterior surface 206 than the lower latch mechanism 204 which is closer to the interior surface 208 of the door 200. An interior handle assembly 212 is mounted to the interior surface 208 of the door 200. A lever 214 like the lever 36 illustrated in FIG. 2 is mounted to the handle assembly 212. The lever 214 rotates a tang 216, which, in turn is received in the drive hub (not shown) of the lower latch mechanism 204. When the lever is rotated, the tang 216 causes the latch mechanism to move between is extended and retracted positions.

The two latch mechanisms 202 and 204 are interconnected by a rack and pinion assembly 220. The rack and pinion assembly 220 is identical to the rack and opinion assembly shown in FIGS. 5 and 6, and further description is not required. The tang 216 is proportioned to extend all the way through the hub of the lower latch mechanism 204 and into a slot like slot 112 (FIG. 5) in a pinion in the rack and pinion assembly 220.

The upper latch mechanism 202 is similarly connected to the rack and pinion assembly. A stub shaft 224 extends through a pinion in the rack and pinion assembly 220 and into the hub (not shown) of the upper latch mechanism. In this way rotation of the lever 214 can be transmitted through the rack and pinion assembly 220 to the upper latch mechanism 202 to actuate that mechanism.

As an alternative to the stub shaft 224, one may use an exterior handle assembly with a tumbler assembly mounted in it like the exterior grip assembly 52 shown in FIGS. 1 and 2.

The tang 216 and the stub shaft 224 can be made to rotate in the same direction by connecting them to the appropriate pinions. For example, if the tang 216 drives the lower most pinion (e.g., 96 in FIG. 5, then the stub shaft 224 is installed through either the 88 or 92. If it is desired to have the engagement hook of the two latch mechanisms face in opposite directions, then it is necessary to have the stub shaft 224 connected to pinion 90 while the tang 216 remains connected to gear 96. Conversely, the stub shaft 224 could be connected to gears 88 or 92, by then the tang would have to be connected to gear 94.

When the interior handle assembly 212 and the exterior handle assembly 230 are mounted to the door 200 machine screws 232 extend from the interior handle assembly 212 through the door and into bosses 234 which project inward from the exterior handle assembly. The rack and pinion assembly is formed with u shaped cutout 238 (FIG. 5) through which one of the machine screws 232 passes. The cut out not only allows the machine screw 232 to pass through, but the machine screw serves to position the rack and pinion assembly inside the door 200. Two cutouts 238 (FIG. 5) are provided to accommodate different styles of handle assemblies which may have different spacing of their mounting screws.

Figure 11:
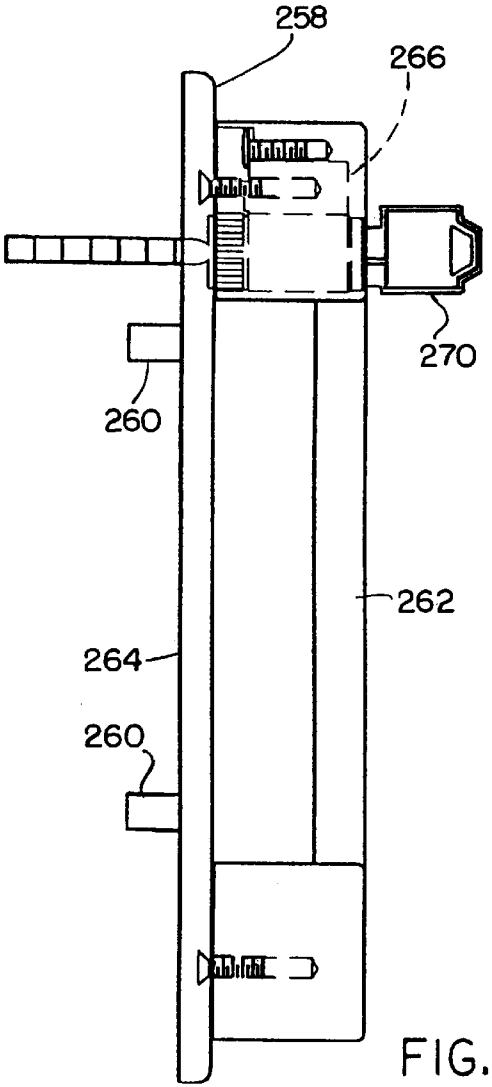
FIG. 11 is a side elevation view of a third embodiment of the present invention, showing an exterior handle assembly with a rack and pinion assembly mounted inside the handle assembly.
Figure 12:
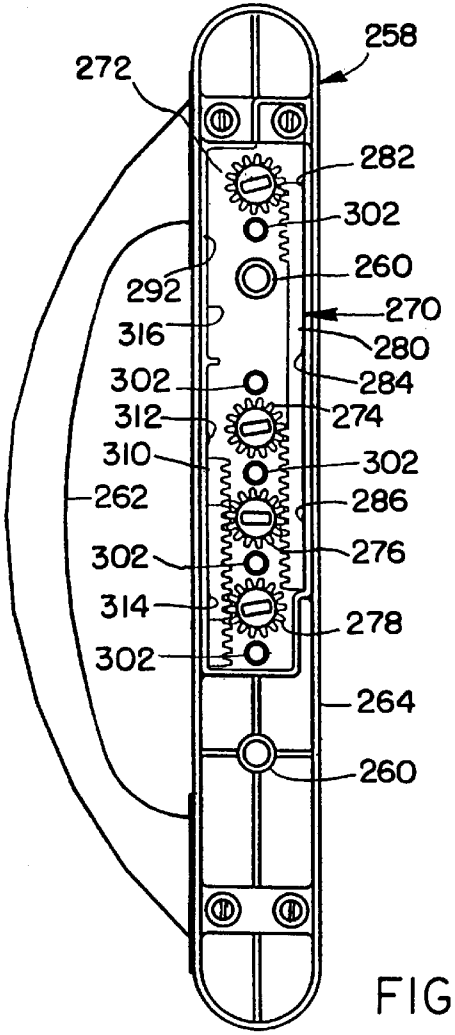
FIG. 12 is a rear elevation view of the assembly of FIG. 11 with the cover plate removed to show the internal components.

FIGS. 11 and 12 illustrate yet another embodiment of the present invention. As illustrated in FIGS. 11 and 12 the exterior grip assembly 258 includes an integral rack and pinion assembly which performs the same function as the separate rack and pinion assembly (e.g., 80 in FIG. 4) in the prior embodiments. Thus the chief structural difference between the rack and pinion assembly 80 and the rack and pinion used in the FIGS. 11 and 12 embodiment is that the exterior escutcheon 264 supports the various pinons and the rack, while in the previously described embodiments, the rack and pinions were supported in a separate housing. Integrating the rack and pinions into the exterior escutcheon makes installation of the exterior grip assembly 258 a simple matter, not different from a prior art exterior grip assembly in which the tumbler assembly is coaxial with, e.g., the tang 38 of the interior grip assembly 14 of FIG. 4. To this end the exterior grip assembly 250 is provided with conventional internally threaded posts 260 which receive machine screws (not shown) inserted through the door from its interior side.

The exterior grip assembly 258 includes an exterior grip 262 which is mounted to an exterior escutcheon 264. The grip 262 includes a tumbler assembly 266 which is identical to the tumbler assembly 68 shown in FIG. 4. The tumbler assembly 266 includes a conventional tang 268 which rotates when the key 270 is inserted into the tumbler assembly and turned.

Figure 13:
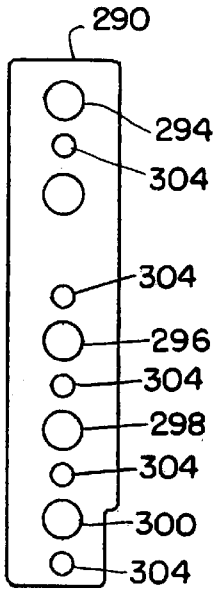
FIG. 13 is a plan view of a cover plate used to close the assembly of FIG. 12 and to secure the components in place.

The exterior escutcheon 264 includes a row of recesses (not shown) which support pinion gears 272, 274, 276, and 278. The pinion gears are free to rotate in the escutcheon 264. A cover plate 290 (FIG. 13) like the cover plate 108 shown in FIG. 6, holds the rack and the pinions 272–278 in place. The cover plate 290 rests in a recess defined by a peripheral shoulder 292 surrounding the interior of the escutcheon 264. The cover plate 290 may be formed from sheet steel, and it has openings 294, 296, 298, and 300 which are coaxial with the pinons 272, 274, 276, and 278, respectively. The openings are proportioned to receive a cylindrical shoulder formed on each of the pinons 272–278 to permit smooth rotation of the pinions.

The cover 290 may be held in place by any suitable means including conventional fasteners. In a preferred embodiment the escutcheon includes five support posts 302 which align each with a corresponding one of five openings 304 in the cover 290. Each of the posts 302 includes a shoulder at its upper end which fits through the corresponding opening 304, after which it is swaged to permanently hold the cover 290 in place.

The pinion 272 is positioned coaxial with the axis of the tumbler assembly 266 so that the tang 268 drives the pinion 272. A rack 280 is mounted for sliding lengthwise movement in the escutcheon along the length of the escutcheon. The escutcheon is formed with dimples 282, 284, and 286 which position the back surface of the rack 280 and so keep the rack's teeth in operative, meshing engagement with the pinions. The pinions 272, 274, 276, and 278 are held against unwanted movement in the axial direction by contact with the escutcheon and the cover plate 290.

Although the FIG. 12 shows four pinions, 272, 274, 276, and 278, only two would typically be used. In the embodiment shown, the pinion 272 engages the rack 280. The rack 280 in turn engages pinion 276 which is centrally located between the top and bottom of the escutcheon 264. An interior grip assembly like the interior grip assembly 14 shown in FIGS. 1, 2, and 4 may be used in conjunction with the exterior grip assembly 258 because the tang 38 (FIG. 4) of the interior grip assembly 14 is centered between the top and bottom of the interior escutcheon 32 and so aligns with the pinion 276.

In the event that the particular interior grip assembly to be used with the exterior grip assembly 258 had a drive tang that was in a different location, the pinion gear 274 could be used. There may be handle configurations in which it is desirable to position the interior lever (e.g. 36 in FIG. 2) in alignment with the pinon 278 (FIG. 12). In this case the rack and pinon assembly 270 also includes a secondary rack 310. This secondary rack serves to inter connect pinions 276 and 278. It is located within the escutcheon 264 and the opposite side from the rack 280 and slides against dimples 312 and 314 which are formed on the side wall of the escutcheon 264.

Because of their relative positions the racks 280 and 310 move in opposite axial directions and the rotation of pinion 278 is always n the opposite direction from the rotation of the pinon 276. This is advantageous where it is necessary to have the interior lever rotate in the opposite direction, and accordingly the escutcheon and the mechanism contained therein can easily be used with either left or right handed grips.

Thus it is clear that the present invention provides a unique arrangement of latch mechanisms, levers for interior actuation of the latch mechanisms, and tumbler assemblies for exterior actuation of the latch mechanism for use in doors, particularly doors with hollow stiles. In one embodiment (FIGS. 1–6), the interior lever 36 is located, as in the prior art, centrally of the interior handle 14, while the tumbler assembly 68 (FIG. 4) is mounted above the lever in a post 66 which supports and forms a part of the exterior handle 12, thus not only making the tumbler more easily accessible but also making it more secure than had been the prior practice. In another embodiment (FIGS. 7–9), the tumbler 150 and interior lever 172 have coaxial tangs, but they are displaced from the hub 182 of the latch mechanism 170, and so the tumbler assembly may be recessed into the door stile 152, thus making it readily accessible and secure. In yet another arrangement (FIG. 10), the door is provided with two latch assemblies 202 and 204 which are vertically offset from each other and actuated by a shared interior lever 214.

In each of these embodiments a rack and pinion assembly 80, 180, and 220, that is made to fit inside a hollow stile of the door beside a conventional latch assembly, is connected to the hub, e.g., 42 (FIG. 4) and 182 (FIG. 7), of the latch mechanism. The rack and pinion assembly includes an input hub 88 which turns a first pinion 90 and an output hub 96 turned by a second pinion 94, the two pinions being connected by a rack 86. The rack and pinion assembly 80 may be provided with a gear train (90) connecting plural input hubs, e.g., 88, 92 with the rack 86 and with a gear train (94) connecting the output hub 96 with the rack. The plural input and output hubs enable the rack and pinion assembly to accommodate a variety of different conventional latch assemblies and handle styles.

In a third embodiment, a rack and pinon assembly is mounted within an escutcheon rather than within a door style, making the assembly useful with solid doors. The rack and pinion assembly 270 accommodates levers in a variety of positions and directions of rotation.

What is claimed is:

1. A door handle assembly comprising an interior handle connected to the interior face of a door, a latch mechanism operable between latched and unlatched positions to secure the door, an operator mounted to the door and rotatable with respect to the handle, and a rack and pinion assembly to transmit rotary motion of the operator to the latch mechanism, wherein the operator includes a tumbler assembly which is mounted substantially entirely within the door.

2. A door handle assembly comprising an interior handle connected to the interior face of a door, a latch mechanism operable between latched and unlatched positions to secure the door, an operator mounted to the door and rotatable with respect to the handle, and a rack and pinion assembly to transmit rotary motion of the operator to the latch mechanism, wherein the operator includes a tumbler assembly and the handle assembly includes a grip, the tumbler assembly being mounted within the grip.

3. A door handle assembly comprising an interior handle connected to the interior face of a door, a latch mechanism operable between latched and unlatched positions to secure the door, an operator mounted to the door and rotatable with respect to the handle, and a rack and pinion assembly to transmit rotary motion of the operator to the latch mechanism, wherein the operator includes a tumbler assembly and wherein the assembly further includes an interior manually operable actuator, the actuator being rotatable about a first axis, and wherein the tumbler includes a shaft rotatable about an axis that is substantially parallel to the axis of rotation of the manually operable actuator, but is spaced from the first axis.

4. A door handle assembly comprising an interior handle connected to the interior face of a door, a latch mechanism operable between latched and unlatched positions to secure the door, an operator mounted to the door and rotatable with respect to the handle, and a rack and pinion assembly to transmit rotary motion of the operator to the latch mechanism, wherein the operator includes a tumbler assembly, and wherein the latch mechanism includes a hub rotatable about a hub axis and the operator includes a shaft rotatable about a second axis which is substantially parallel to and spaced from the hub axis.

5. The assembly of claim 4 wherein the operator includes a manually operable actuator.

6. The assembly of claim 5 wherein the manually operable actuator includes a shaft rotatable about an actuator axis, and the actuator axis is substantially coaxial with the second axis.

7. The assembly of claim 5 wherein the manually operable actuator includes a shaft rotatable about an actuator axis, the actuator axis being substantially coaxial with the hub axis.

8. A door handle assembly comprising an interior handle connected to the interior face of a door, a latch mechanism operable between latched and unlatched positions to secure the door, an operator mounted to the door and rotatable with respect to the handle, and a rack and pinion assembly to transmit rotary motion of the operator to the latch mechanism wherein the rack and pinion assembly includes a housing having first and second planar members, first and second pinions mounted between the planar members for rotation therebetween, and a rack disposed in meshing engagement with the pinions to transmit rotary motion of one pinion to the other and further including third and fourth pinions mounted for rotation between the first and second planar members and disposed in meshing engagement each with one of the first and second pinions.

9. The assembly of claim 8 further including a fifth pinion mounted for rotation between the first and second planar members and disposed in meshing engagement with one of the first and second pinions.

10. The assembly of claim 8 wherein each of the pinions includes a central passage proportioned to receive a shaft and to transmit rotary motion between the shaft and the pinion.

11. The assembly of claim 9 wherein each of the pinions includes a central passage proportioned to receive a shaft and to transmit rotary motion between the shaft and the pinion.

12. A door handle assembly comprising an interior handle assembly and an exterior handle assembly mounted to the interior and exterior surfaces, respectively, of a stile of a door, a latch mechanism mounted between the interior and exterior handle assemblies, the latch mechanism having an input hub rotatable about a hub axis substantially normal to the interior and exterior surfaces of the door, an operator having a shaft rotatable about an operator axis substantially parallel to the hub axis, and a rack and pinion assembly having a first pinion operatively connected to the latch hub and a second pinion operatively connected to the operator shaft, the rack and pinion assembly further including a rack transmitting motion between the first and second pinions, whereby the hub axis is spaced from the operators' axis and rotation of the operator shaft causes rotation of the input hub of the latch mechanism, wherein the operator includes a manually operable tumbler assembly, the tumbler assembly being mounted substantially within the stile.

13. A door handle assembly comprising an interior handle assembly and an exterior handle assembly mounted to the interior and exterior surfaces, respectively, of a stile of a door, a latch mechanism mounted between the interior and exterior handle assemblies, the latch mechanism having an input hub rotatable about a hub axis substantially normal to the interior and exterior surfaces of the door, an operator having a shaft rotatable about an operator axis substantially parallel to the hub axis, and a rack and pinion assembly having a first pinion operatively connected to the latch hub and a second pinion operatively connected to the operator shaft, the rack and pinion assembly further including a rack transmitting motion between the first and second pinions, whereby the hub axis is spaced from the operator axis and rotation of the operator shaft causes rotation of the input hub of the latch mechanism, wherein the operator includes a manually operable tumbler assembly, the tumbler assembly being mounted within the handle assembly.

14. The assembly of claim 13 wherein the exterior handle assembly includes a grip having at least one post mounting the grip to the exterior of the door, the tumbler assembly being mounted in the post.

15. A door handle assembly comprising an interior handle assembly and an exterior handle assembly mounted to the interior and exterior surfaces, respectively, of a stile of a door, a latch mechanism mounted between the interior and exterior handle assemblies, the latch mechanism having an input hub rotatable about a hub axis substantially normal to the interior and exterior surfaces of the door, an operator having a shaft rotatable about an operator axis substantially parallel to the hub axis, and a rack and pinion assembly having a first pinion operatively connected to the latch hub and a second pinion operatively connected to the operator shaft, the rack and pinion assembly further including a rack transmitting motion between the first and second pinions, whereby the hub axis is spaced from the operator axis and rotation of the operator shaft causes rotation of the input hub of the latch mechanism, further including a second latch assembly, the second latch assembly having a second input hub rotatable about a second hub axis substantially parallel to the first hub axis, the second input hub being connected to the operator shaft.

16. A door handle assembly comprising an interior handle assembly and an exterior handle assembly mounted to the interior a exterior surfaces, respectively, of a stile of a door, a latch mechanism mounted between the interior and exterior handle assemblies, the latch mechanism having an input hub rotatable about a hub axis substantially normal to the interior and exterior surfaces of the door, an operator having a shaft rotatable about an operator axis substantially parallel to the hub axis, and a rack and pinion assembly having a first pinion operatively connected to the latch hub and a second pinion operatively connected to the operator shaft, the rack and pinion assembly further including a rack transmitting motion between the first and second pinions, whereby the hub axis is spaced from the operators' axis and rotation of the operator shaft causes rotation of the input hub of the latch mechanism, and wherein the rack includes a first end portion and a second end portion and a first and second gear train, the first gear train including the first pinion and being driven by the first end portion of the rack and the second gear train including the second pinion and being driven by the second end portion of the rack wherein the first gear train includes at least two gears, one gear disposed in meshing engagement with the first end portion of the rack and the other gear disposed in meshing engagement with the one gear, whereby the two gears rotate in opposite directions upon axial movement of the rack.

17. The assembly of claim 16 wherein the first gear train includes a third gear disposed in meshing engagement with the one gear.

18. The assembly of claim 16 wherein the rack and pinion assembly includes a housing having a front and rear plate, the front and rear plates rotatably supporting the gears of the first and second gear trains, and the housing having a bearing surface against which the rack slides axially, the bearing surface positioning the rack in meshing engagement with one gear of each of the two gear trains.

19. The assembly of claim 12 wherein the rack includes a first end portion and a second end portion and a first and second gear train, the first gear train including the first pinion and being driven by the first end portion of the rack and the second gear train including the second pinion and being driven by the second end portion of the rack.

20. The assembly of claim 19 wherein the first gear train includes at least two gears, one gear disposed in meshing engagement with the first end portion of the rack and the other gear disposed in meshing engagement with the one gear, whereby the two gears rotate in opposite directions upon axial movement of the rack.

21. The assembly of claim 20 wherein the first gear train includes a third gear disposed in meshing engagement with the one gear.

22. The assembly of claim 21 wherein the rack and pinion assembly includes a housing having a front and rear plate, the front and rear plates rotatably supporting the gears of the first and second gear trains, and the housing having a bearing surface against which the rack slides axially, the bearing surface positioning the rack in meshing engagement with one gear of each of the two gear trains.

23. The assembly of claim 13 wherein the rack includes a first end portion and a second end portion and a first and second gear train, the first gear train including the first pinion and being driven by the first end portion of the rack and the second gear train including the second pinion and being driven by the second end portion of the rack.

24. The assembly of claim 23 wherein the first gear train includes at least two gears, one gear disposed in meshing engagement with the first end portion of the rack and the other gear disposed in meshing engagement with the one gear, whereby the two gears rotate in opposite directions upon axial movement of the rack.

25. The assembly of claim 24 wherein the first gear train includes a third gear disposed in meshing engagement with the one gear.

26. The assembly of claim 25 wherein the rack and pinion assembly includes a housing having a front and rear plate, the front and rear plates rotatably supporting the gears of the first and second gear trains, and the housing having a bearing surface against which the rack slides axially, the bearing surface positioning the rack in meshing engagement with one gear of each of the two gear trains.

27. A rack and pinion assembly for use with a door having interior and exterior surfaces and a latch mechanism with an input hub rotatable about a hub axis and an operator having a shaft that rotates about an operator axis, the rack and pinion assembly having a housing, a first pinion rotatably mounted in the housing and adapted to be connected to the input hub, and a second pinion rotatably mounted in the housing adapted to receive the operator shaft, and a rack for transmitting motion between the first and second pinions whereby the hub axis may be spaced from the operator axis and rotary motion of the operator shaft may be transmitted to the input hub of the latch mechanism, wherein the rack includes a first end portion and a second end portion and first and second gear trains, the first gear train including the first pinion and being driven by the first end portion of the rack and the second gear train including the second pinion and being driven by the second end portion of the rack, and wherein the first gear train includes at least two gears, one gear disposed in meshing engagement with the first end portion of the rack and the other gear disposed in meshing engagement with the one gear, whereby the two gears rotate in opposite directions upon axial movement of the rack.

28. The assembly of claim 27 wherein the first gear train includes a third gear disposed in meshing engagement with the one gear.

29. The rack and pinion assembly of claim 28 wherein the housing has a front and rear plate, the front and rear plates rotatably supporting the gears of the first and second gear trains, and the housing having a bearing surface against which the rack slides axially, the bearing surface positioning the rack in meshing engagement with one gear of each of the two gear trains.

30. A rack and pinion assembly for use with a door having interior and exterior surfaces and a latch mechanism with an input hub rotatable about a hub axis and an operator having a shaft that rotates about an operator axis, the rack and pinion assembly having a housing, a first pinion rotatably mounted in the housing and adapted to be connected to the input hub, and a second pinion rotatably mounted in the housing adapted to receive the operator shaft, and a rack for transmitting motion between the first and second pinions whereby the hub axis may be spaced from the operator axis and rotary motion of the operator shaft may be transmitted to the input hub of the latch mechanism, including an escutcheon mounted to one of the interior and exterior surfaces of the door, the escutcheon forming a portion of the housing and having surfaces against which the rack slides and wherein the rack and pinion assembly includes a third pinion mounted for rotation in the escutcheon and rotatable about an axis parallel to and spaced from the axis of the second pinion upon axial movement of the rack.

31. The assembly of claim 30 wherein the third pinion is disposed in meshing engagement with the rack.

32. The assembly of claim 30 wherein the third pinion rotates in the same direction as the second pinion when the rack moves axially.

33. The assembly of claim 30 wherein the third pinion rotates in the opposite direction from the second pinion when the rack moves axially.

34. The assembly of claim 33 including a second rack mounted in the housing for axial movement, the second rack being disposed in engagement with the second pinion.

35. The assembly of claim 34 wherein the second rack moves in the axially opposite direction from the rack when the rack moves axially.

36. The assembly of claim 34 wherein the second rack is disposed in meshing engagement with the second and third pinions.

37. The assembly of claim 36 wherein the second rack causes the third pinion to rotate in the opposite direction from the second pinion upon axial movement of the rack.

* * * * *